United States Patent [19]

Lienert

[11] Patent Number: 4,492,102

[45] Date of Patent: Jan. 8, 1985

[54] SEPARATING AND FEEDING SYSTEM FOR A SHOT PEENING MACHINE

[75] Inventor: Gerold Lienert, Georgetown, Canada

[73] Assignee: Rockwell International Corporation, Pittsburgh, Pa.

[21] Appl. No.: 445,393

[22] Filed: Nov. 30, 1982

[51] Int. Cl.[3] ..... B21J 5/00

[52] U.S. Cl. ..... 72/53; 29/90 A; 51/420; 198/341; 198/469

[58] Field of Search ..... 72/53; 51/420, 417, 51/410; 29/90 A; 414/289, 161; 198/341, 861, 469, 470, 491; 53/493; 493/30

[56] References Cited

U.S. PATENT DOCUMENTS

| | | | |
|---|---|---|---|
| 2,154,879 | 4/1939 | Turnbull | 51/420 |
| 2,341,674 | 2/1944 | Wallace | 72/53 |
| 3,383,803 | 5/1968 | Schulte et al. | 72/53 |
| 3,490,194 | 1/1970 | Monaghan | 53/372 |
| 3,604,158 | 9/1971 | Daffron | 51/420 |
| 3,626,641 | 12/1971 | Powell et al. | 51/420 |
| 3,760,553 | 9/1973 | Schmidt, Sr. et al. | 53/493 |

*Primary Examiner*—Daniel C. Crane
*Assistant Examiner*—David B. Jones

[57] ABSTRACT

A separating and feeding system for a shot peening machine is of the type which includes blast wheels mounted on a housing of the machine and capable of propelling a plurality of shot generally downwardly into a critical blast region within the housing for shot peening a plurality of springs passing therethrough. The springs are supported on and separately conveyed along a pair of spaced spinner rolls along a peening path into one side of and through the critical blast region. The separating and feeding system includes an entrance chamber within the housing adjacent the one side of the critical blast region. An elongated horizontally extending chain is mounted relative to the housing for continuous movement from a first end exterior of the housing through an opening in a wall of the housing to a second end within the entrance chamber at the one side of the critical blast region. The horizontally extending chain supports the springs thereon and makes frictional contact therewith to transport the springs from the one end to the second end. The chain is capable of continued movement beneath any of the springs which are prevented by retarding gates from continuing transportation. A shot screening and spring stopping gate is in a normally closed position at the opening to prevent escape of shot therethrough and entrance of one of the springs into the entrance chamber. When there is no spring at the one side of the critical blast region, a signal is provided for opening the shot screening and spring stopping gate for a predetermined amount of time to allow the chain to transport the one spring to the critical blast region.

5 Claims, 5 Drawing Figures

SEPARATING AND FEEDING SYSTEM FOR A SHOT PEENING MACHINE

BACKGROUND OF THE INVENTION

1. Field of the Invention

This invention relates to a separating and feeding system for a shot peening machine and more particularly to such a separating and feeding system which will automatically supply a work piece to a critical blast region of the machine when it is capable of receiving the work piece while insuring that there will be no escape of shot from the interior of the machine.

2. Description of the Prior Art

It is well known that the fatigue life of springs or similar types of work pieces that are subjected to repeated flexing stresses may be increased by cold working of the fibers at and near the surface of the metal by shot peening or blasting. For larger coil springs such as those used in automobile suspensions, it is not uncommon to provide a shot peening machine for conveying the springs through a fan-shaped shot stream with the springs being rotated about their axis for substantially uniform cold working of the entire surface.

A number of such shot peening machines have been heretofore successfully employed and include blast wheels and shot recirculation, fines separation and dust collecting systems which are well known to those skilled in the art. Although shown in a simplified form, U.S. Pat. No. 2,249,677 includes such a machine and, in one embodiment thereof, discloses a pair of spaced parallel spinner rolls which are mounted for rotation to support and rotate each spring being conveyed through the machine. Specifically, the springs are conveyed by a belt and finger arrangement which is located between the spinner rolls with each finger being capable of advancing an individual spring therethrough. A similar machine is shown in a simplified form in U.S. Pat. No. 2,341,674.

Still another prior art shot peening machine is shown in U.S. Pat. No. 3,383,803, which includes some discussion and explanation of the blast wheels and the shot recirculation system for returning shot to the blast wheels. The blast wheels provide the shot to an enclosed blast cabinet which is intended to contain all of the shot being used during the process. The prior art machine disclosed therein, however, utilizes a different means than discussed hereinabove for conveying and rotating a spring therethrough. This method is limited to coil springs which are formed with non-flattened ends. An elongated rotatable support roll extends continuously lengthwise through the machine and includes a plurality of annular ribs extending radially outwardly from the periphery of the roll. The ribs are axially spaced one from the other by a distance corresponding to the coil pitch of each coil spring to be supported thereon. Additionally, a pair of guide rollers are mounted for rotational movement about an axis parallel with the support roll but are spaced laterally one from the other and above the support roll. The space defined by the rolls is intended to loosely receive each coil spring therein. The guide rolls also extend continuously lengthwise through the machine and corresponding rotation of the guide rolls and the support roll causes rotation of the coil spring which results in it being conveyed through the machine as each coil spring is progressively advanced along the annular ribs of the support roll.

Still another prior art shot peening machine is disclosed in U.S. Pat. No. 3,604,158. This machine is also intended to rotate and convey cylindrical work pieces such as coil springs but utilizes a different conveying method than those described hereinabove. In order to provide for the transportation of each spring through the blast cabinet, a feed roll having a screw flight is mounted for rotation to progressively convey the springs through the machine. To maintain the springs in a spaced-apart relationship to insure that the shot can be directed to the ends thereof, the pitch of the screw is greater than the overall length of a spring. The spring is maintained in place on the feed roll by a pair of guide rolls which are mounted in a common horizontal plane slightly above the feed roll at a distance which is less than the spring diameter. Throughout the peening process, the guide rolls and feed roll are caused to rotate to impart a rotating motion to the springs to insure that the entire surface of each will be properly cold worked. In another embodiment disclosed in U.S. Pat. No. 3,604,158, a pair of fixed or rotating support rolls support a coil spring therebetween but axial movement of each spring is produced in a manner similar to those disclosed in the prior art devices mentioned hereinabove. Specifically, there is provided a plurality of fingers on a moving conveyor chain which is mounted between and below the support rolls. This embodiment still employs rotating guide rolls above and at opposite sides of the springs to produce rotation thereof as each spring is axially moved through the blast cabinet.

While each of the above described prior art shot peening machines appears to satisfactorily transport and rotate springs through a blast cabinet to insure proper shot peening of the entire surface of such springs, each of these machines includes features which cause them to be expensive to provide and costly to maintain. It has been found that any element located inside the blast cabinet in a critical blast region (a region in which shot which is provided by the blast wheels will still be traveling near to its maximum impact speed) is subjected to extensive wear. To increase the life of these elements, they are often manufactured of relatively expensive wear-resistant material, such as manganese steel alloy. Even though extensive manganese steel alloy protection plates and deflectors made of stock material may be provided to reduce and minimize this life-shortening damage to the various, more expensive, machined and manufactured components within the blast cabinet, they must nevertheless be periodically replaced and are just as expensive to replace as they were when initially provided.

Additionally, although the prior art shot peening machines discussed hereinabove appear to be primarily concerned with conveying and rotating coil springs through the critical blast regions of their respective shot peening machines, the particular components used for these purposes are also used to simultaneously feed the springs into the critical blast region and discharge the spring from the critical blast region. Accordingly, the various components required for the primary functions in the critical blast region must by necessity be sufficiently long to perform these additional functions. Any design requirement that would add to their overall length would tend to increase their initial cost and any future costs periodically required for their replacement.

SUMMARY OF THE INVENTION

It is therefore an object of this invention to provide a separating and feeding system for a shot peening machine which is simple to provide and insures automatic feeding of work pieces therethrough while preventing the escape of shot from the interior thereof.

These and other objects of the invention are provided in a preferred separating and feeding system for a shot peening machine of the type which includes blast wheel means or the like which is mounted on a housing thereof and is capable of propelling a plurality of shot generally downwardly into the critical blast region within the housing for shot peening a plurality of work pieces passing therethrough. The work pieces are supported on and separately conveyed along a horizontal peening path into one side of, through, and out another side of the critical blast region. The separating and feeding system includes an entrance chamber within the housing adjacent the critical blast region at the one side thereof. An elongated, horizontally extending support surface is mounted relative to the housing for continuous movement from a first end exterior of the housing through an opening in a wall of the housing to a second end within the entrance chamber at the one side of the critical blast region. The horizontally extending support surface is capable of supporting the work pieces thereon and making sufficient frictional contact therewith for transportation of the work pieces from the first to the second end thereof. The horizontally extending support surface is able to continue its movement beneath any of the work pieces which are prevented by retarding means from continuing transportation. The retarding means includes as shot screening and work pieces stopping gate in a normally closed position at the opening to prevent escape of shot therethrough and entrance of one of the work pieces into the entrance chamber. There is means for indicating when one side of the critical blast region is available for delivery of the one work piece thereto. The means for indicating produces a signal for opening the shot screening and work piece stopping gate for a predetermined amount of time to allow movement of the horizontally extending support surface to cause the transportation of the one work piece into the entrance chamber, to the second end of the horizontally extending support surface and to the one side of the critical blast region.

DETAILED DESCRIPTION OF THE PREFERRED EMBODIMENT

Figure 1A:
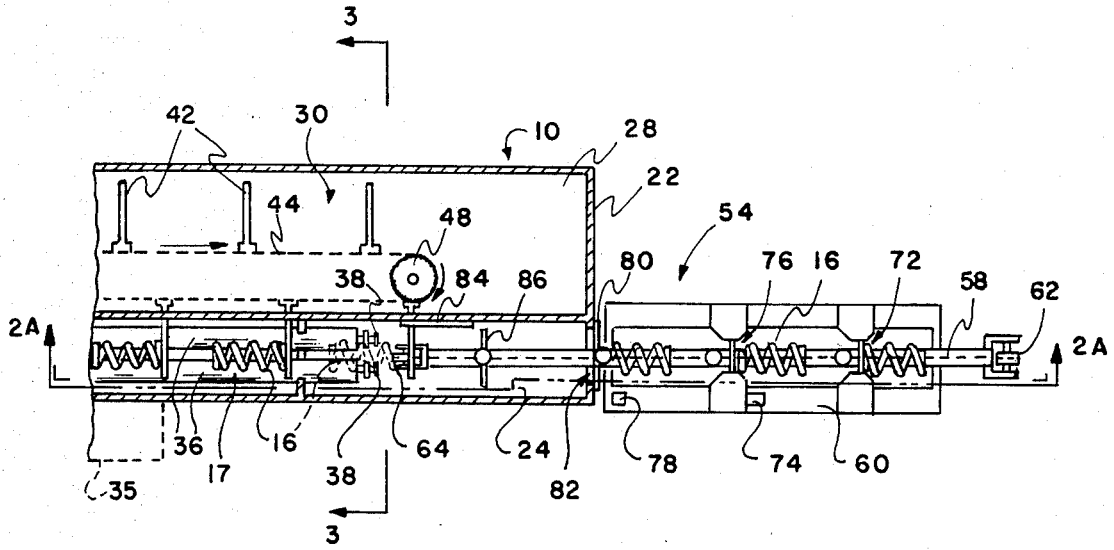
FIGS. 1A and 1B are a top view of the preferred shot peening machine with portions of the housing thereof removed and/or shown in phantom for a better view of various features of the invention.
Figure 2A:
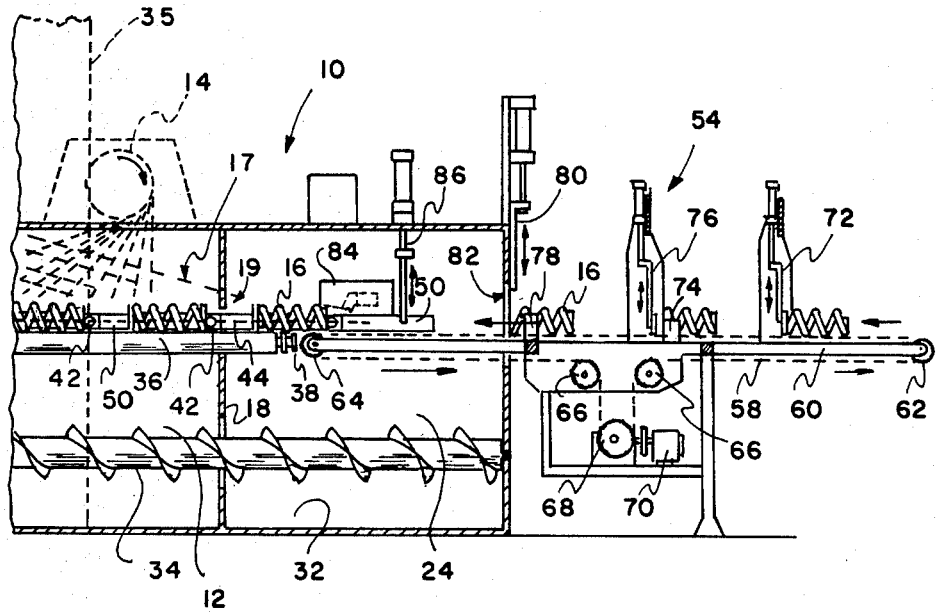
FIGS. 2A and 2B are a sectional elevation view of the preferred shot peening machine as seen generally along line 2—2 of FIGS. 1A and 1B.
Figure 1B:
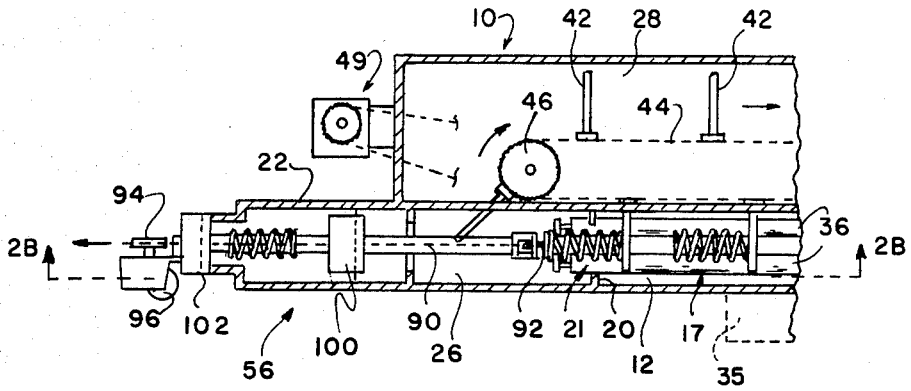
Figure 2B:
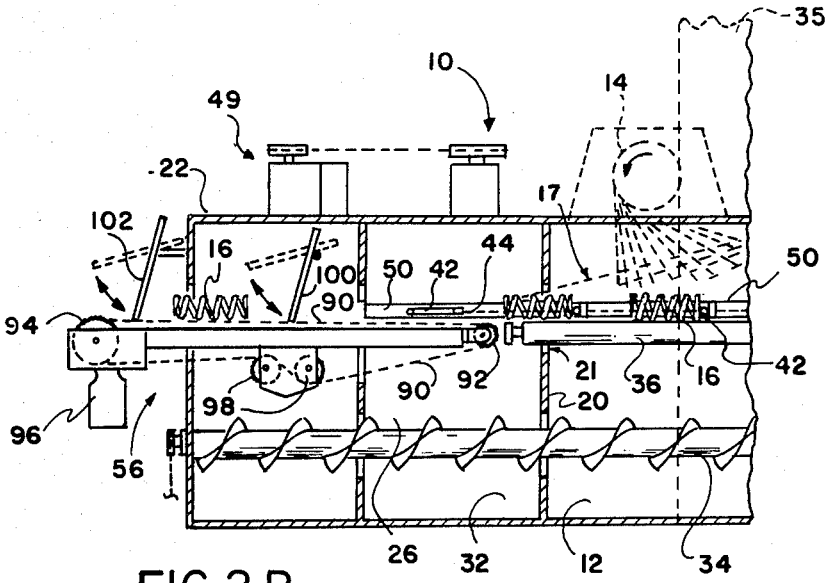
Figure 3:
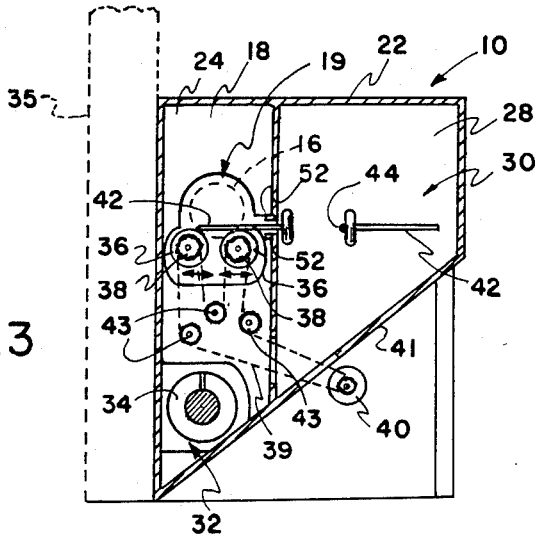
FIG. 3 is a sectional view of the preferred shot peening machine as seen along line 3—3 of FIG. 1A.

As seen in FIGS. 1A, 1B, 2A, 2B and 3, the preferred shot peening machine 10 includes a blast cabinet 12, the top of which supports a pair of blast wheels 14. The blast wheels 14 are capable of directing a plurality of shot generally downwardly under sufficent force for cold working work pieces such as springs 16. More specifically, the blast wheels 14 rotate in opposite directions to direct the shot to opposite ends of a spring 16 passing through the blast cabinet 12.

The top, bottom, sidewalls, and end walls 18, 20 of the blast cabinet 12 generally define the critical blast region 17 and are made of the wear-resistant metal as described hereinabove. They only generally define the critical blast region 17 because of access holes 19, 21 respectively through walls 18, 20 which are needed to allow passage of the springs 16 into and through the blast cabinet 12. Some shot at working speed could travel a short distance through the holes 19, 21.

Since shot cannot be limited to the blast cabinet 12 below the blast wheels 14, the overall shot peening housing 22 is extended to include three other primary chambers thereof. An entrance chamber 24 is basically enclosed to prevent ricocheting and bouncing shot from escaping from the housing as the springs are being fed to the critical blast region 17. Similarly, an exit chamber 26 provides a region for retention of ricocheting and bouncing shot as the springs are being discharged from the primary blasting region. A back chamber 28 extends almost the entire length of the housing 22 and will be seen to enclose a conveying means 30 therein. It will be seen that the overall shot peening housing 22 is intended to retain all of the shot within the interior thereof. Even though the critical blast region 17 is the specific area designated for the desired cold working of the springs 16, there is no way of insuring that the shot will not escape the blast cabinet 12 and be propelled at a lower speed into the entrance chamber 24, exit chamber 26 or the back chamber 28.

In the base of the shot peening housing 22 is a trough 32 which extends the entire length thereof for the receipt and collection of spent shot and other solids removed from the surface of the coil springs 16. An auger 34 is provided therein and is mounted for rotation to deliver the spent shot and other solids to an elevator (not shown) within a housing 35. Such elevators are well known in prior art shot peening machines to be capable of delivering the material from the lower region of the shot peening housing 22 to a separator (not shown) above the blast wheels 14 for removal of undesired solids and the resupply of shot to the blast wheels 14.

It is essential in the transmission of the coil springs 16 through the blast cabinet 12 and the critical blast region 17 thereof, that the springs 16 be properly supported and caused to rotate to insure that the shot will be directed to all surfaces thereof. In the preferred shot peening machine 10, a pair of spinner rolls 36 are provided for this purpose. Specifically, the spinner rolls 36 are horizontally mounted with their axes parallel and slightly separating one from the other. As will be discussed hereinbelow, the space therebetween will depend upon the specific diameter of the coil springs 16 which are being peened. They clearly must be significantly closer than the overall diameter of the spring 16 to insure it will be properly supported between the spinner rolls 36. Depending on the size and shape of the springs to be peened, it may be desirable to include side rails or guides (not shown) which are horizontally above the spinner rolls 36 and extend the length of the critical blast region 17. The rails would not normally make contact with the springs 16 when properly positioned between the spinner rolls 36 but would insure that the springs 16 will not be dislocated by the shot or the rotation of the rolls 36.

The spinner rolls 36 are mounted for rotation at their exit end just inside the exit chamber 26 and are caused to be rotated by a common chain drive system at a pair of sprockets 38 at the entrance end thereof. Although not shown in FIGS. 1A, 1B, 2A or 2B to simplify the drawings, a chain 39 can be seen in FIG. 3 to be driven by a variable speed motor 40 which is mounted beneath shot peening housing 22 below the inclined wall 41 at the base of the back chamber 28. Idler sprockets 43 are provided within the entrance chamber 24 to direct the chain 39 to one sprocket 38, down to one of the another idler sprocket 43 and back up to the other sprocket 38 to prevent the chain 39 from interfering with each spring 16 as it is being fed to the spinner rolls 36. Although the sprockets 38, 43 and chain 39 are located in the entrance chamber 24 at the edge of the cirtical blast region 17, shielding (not shown) is provided to minimize the wear thereto that would be caused by stray shot in the entrance chamber 24.

As thus described, it can be seen that the spinner rolls 36 are provided an overall length which enables them to properly perform their primary function. The spinner rolls 36 can be seen to terminate at the edges of the initial blast region 17 and will only support the spring 16 and impart a rotating motion thereto when the springs 16 are in the critical blast region 17. As a result, the spinner rolls 36, which are cast of manganese steel alloy and are relatively expensive to provide, are designed to have a minimal overall expense. The spinner rolls 36 are not required in the preferred shot peening machine 10 to perform the additional functions of feeding the springs 16 to the initial blast region and discharging the springs therefrom.

Although the spinner rolls 36 will properly support and rotate the springs 16 in the critical blast region 17, a conveying means 30 must be provided to longitudinally convey each spring 16 therethrough. The preferred conveying means 30 includes a plurality of horizontally extending fingers 42 on a conveyor chain 44. The conveyor chain 44 is mounted to form a loop which extends horizontally in the back chamber 28 between a driven sprocket 46 and an idler sprocket 48. The sprockets 46, 48 are mounted with their axes extending vertically. The idler sprocket 48 is located prior to the entrance end of the spinner rolls 36 while the driven sprocket 46 is located rearwardly of the exit end of the spinner rolls 36. The driven sprocket 46 is caused to rotate by a variable speed motor and pulley configuration 49 mounted on the shot peening housing 22 so that it will not be in contact with or effected by any of the shot supplied to the critical blast region 17.

Specifically, as the chain 44 is caused to pass over the sprockets 46, 48, the plurality of fingers 42 which are spaced a predetermined distance apart will be extended into the entrance chamber 24 and passed horizontally through the blast cabinet 12 and into the exit chamber 26. A longitudinally extending slot 50 on the back wall of the entrance chamber 24, blast cabinet 12 and exit chamber 26 allows each finger 42 to extend laterally of the peening path from the back chamber 28 into the critical blast region 17 while being capable of passing above the spinner rolls 36 to convey each spring 16 longitudinally and horizontally therealong. Since the longitudinally extending slot 50 provides the only access for the fingers 42 to the critical blast region 17, any shot which could impinge on the chain 44 must pass through the slot 50 in order to enter the interior of the back chamber 28. To further minimize access to the slot 50, the preferred shot peening machine 10 is provided a pair of narrow, horizontally extending shelves 52 (FIG. 3) above and below the slot 50 to deflect the shot and prevent any direct impingement on the chain 44.

It can be seen that the preferred shot peening machine 10 includes a conveying system which is basically capable of conveying the springs 16 along the spinner rolls 36 in a manner which is different from methods disclosed in the prior art machines described hereinabove. By providing a different orientation for the fingers 42 and having them driven by a chain 44 which is capable of being located remotely from the critical blast region 17, no appreciable damage or wear should be experienced in the chain 44. Obviously, the fingers 42 would be subjected to direct impingement by the shot and would have to be made of wear-resistant metal. However, periodic replacement of the fingers 42 which are relatively simple to design and form would be significantly cheaper than the required replacement of the entire chain configuration which was, in some of the prior art machines, designed to pass through the critical blast region 17. The same comparison of cost could be made for the fingers 42 when compared to prior art configurations which used additional rolls in the critical blast region 17.

There is an additional advantage gained by the use of horizontally extending fingers 42. As seen in the prior art shot peening machines which incorporate chain driven fingers which extend vertically between spinner or support rolls, space must be provided for the fingers therebetween. With practical limits on the degree to which the space between the rolls could be reduced, any spring being peened therein must have a diameter which is sufficiently large to insure that it could be adequately supported by the rolls. However, in the preferred shot peening machine 10, there has been provided means for adjusting the spinner rolls 36 to decrease the space therebetween to accommodate coil springs with smaller diameters. In the machine 10, this adjustment (as indicated by the double-ended arrows in FIG. 3) is no longer limited by the size or width of any vertically extending fingers which were heretofore needed to convey the springs through the critical blast region.

Since the preferred shot peening machine 10 includes a configuration which requires a minimum number of components to be included in the critical blast region 17, it is necessary to provide a separating and feeding system 54 to supply the springs 16 to the interior of the machine 10 and a discharge system 56 to discharge the springs 16 after the peening operation is completed. While these two systems may initially appear to add to the overall cost and complexibility of the preferred shot peening machine 10, it should be kept in mind that the prior art machines described hereinabove by necessity utilized relatively expensive components to provide the same functions. Additionally, these components had to be periodically, entirely replaced because of the wear and damage which existed in the critical blast region 17. Therefore, even though there is some additional initial costs, the costs are relatively small and the components used in the separating and feeding system 54 and the discharge system 56 would not need to be made of the more expensive and durable material since they would not be subjected to shot in the critical blast region 17.

In order to provide automatic feeding for the preferred shot peening machine 10, the separating and feeding system 54 is aligned with the spinner rolls 36 to extend horizontally from the exterior of the shot peening housing 22 to terminate within the interior of the entrance chamber 24. Specifically, springs 16 are placed on the upper surface of a transmission roller chain or similar type of chain 58 with an upward portion thereof moving horizontally toward the spinner rolls 36. The chain 58 is mounted on a frame 60 and forms a loop in a vertical plane as it passes around a leading sprocket 62 and a trailing sprocket 64. The chain 58 is caused on its lower, return pass to be redirected over idler rollers 66 to a driving sprocket 68 and motor drive 70 mounted below the frame 60. The surface of the chain 58 has sufficient frictional qualities to longitudinally move a spring 16 which is placed thereon. Side rails or guides (not shown) insure that the springs 16 are maintained in a longitudinal orientation and prevent them from rolling off of the upper surface of the chain 58. The speed of the motor drive 70 can be varied and, as will be discussed in detail hereinbelow, the feeding speed for the chain 58 can be selected according to the speed of the fingers 42. It is sufficient at this time to simply understand that the chain 58 will move horizontally faster than will the fingers 42.

Clearly, simply providing a horizontally, longitudinally moving chain 58 to supply springs 16 to the critical blasting region 17 would be inadequate since a means must be provided to insure that there is only one spring 16 in position as each finger 42 is extended into the entrance chamber 24 for conveying it through the critical blasting region 17. As a result, the separating and feeding system 54 is provided a plurality of gates to separate the springs 16 and to regulate the timing of their entrance to the interior of the machine 10. The gates will be seen to operate independently of the speed of the motor drive 70 and chain 58 even though the particular timing will be effected by the physical movement of the respective springs 16 along the upper surface of the chain 58.

To initially produce separation of a plurality of springs 16, a first gate 72 is normally open until a spring 16 which has passed therethrough is positioned at a first spring sensing device 74 which is located just prior to a second gate 76. The second gate 76 would also initially be in an open position so that a spring 16 passing through the first gate 72 might be sensed at the first spring sensing device 74 and continue on through the second gate 76. However, as the spring 16 passes through the first spring sensing device 74 a signal will be transmitted to close the first gate 72. The first gate 72 includes a vertically depending retarding finger which will prevent the next spring 16 from passing therethough. The retarding finger is elongated and has relatively small cross-sectional dimensions so that it is possible that the retarding finger of the first gate 72 might extend through the coils of a spring 16 positioned half way through the gate 72. Nevertheless, this still would retard the spring 16 in a manner which would be sufficient for its eventual supply to the subsequent gates. When the first gate 72 or the second gate 76 is closed, it should be understood that the springs 16 will simply be prevented from moving longitudinally with the upper surface of the chain 58 as the chain 58 continues to slide thereunder.

When a spring 16 has passed through the second gate 76, it will proceed to a second spring sensing device 78 located exterior of the housing 22. The second spring sensing device 78 will send a signal to close the second gate 76 and simultaneously open the first gate 72. Normally, a spring 16 initially arriving at the second spring sensing device 78 would be on the chain 58 traveling into the shot peening housing 22 but would be prevented from entering by a spring stop and shot sealing gate 80. The spring stop and shot sealing gate 80 includes sufficient cross-sectional dimensions to completely cover an access opening 82 to the housing 22 and the entrance chamber 24. As a result, the spring stop and shot sealing gate 80 will prevent undesirable escape of shot from the interior of the preferred shot peening machine 10 and would only be open sufficiently long to allow the passage of a spring 16 therethrough.

In order to determine when a spring 16 should be provided through the spring stop and shot sealing gate 80, a finger position sensing device 84 is provided in the interior of the entrance chamber 24 to determine when each finger 42 is passing thereby. Specifically, the preferred finger position sensing device 84 includes a camming element and a proximity switch (not shown) which will send a signal as each finger 42 is brought to a lateral position for conveying a spring 16 along the peening path through the critical blast region 17. When the finger position sensing device 84 is activated by a finger 42, the spring stop and shot sealing gate 80 receives a signal to open. Simultaneously, a secondary shot sealing gate 86 mounted within the entrance chamber 24 would be given a signal to close. The secondary shot sealing gate 86 is simply intended to insure deflection of shot from the access opening 82 during the short time that the spring stop and shot sealing gate 80 is in an open position. After a predetermined amount of time, which is preset in the control system and is predetermined according to the length of the springs 16 and the speed of the shot peening operation, the spring stop and shot sealing gate 80 will close, the secondary sealing gate 86 will open and the second gate 76 will open. Basically, this simultaneous operation is intended to allow a spring 16 being held at the spring stop and shot sealing gate 80 to pass completely through the opening 82 and then allow the gate 80 to close therebehind. The timing should be such that the secondary shot sealing gate 86 will be retracted prior to the spring 16 being longitudinally transmitted thereto. In other words, the secondary shot sealing gate 86 is not intended to and should not retard any of the springs 16 but simply serve as a barrier for the shot while the gate 80 is in an open position. As indicated, simultaneously, the second gate 76 will open to provide another spring 16 to the now closed spring stop and shot sealing gate 80 but will again be caused to close as soon as that spring 16 is positioned at the second spring sensing device 78. Once the spring 16 is at the second spring sensing device 78, as indicated hereinabove, the first gate 72 is then returned to its normal opened position and the spring 16 which had heretofore been retarded thereby would be released to be transported to the closed second gate 76. Again, the second gate 76 being in the closed position prevents further longitudinal movement of any spring 16 therethrough to establish the basic separation of the springs 16 as is needed to allow for the timed closure of the spring stop and shot sealing gate 80.

Clearly, as a finger 42 is brought to the finger position sensing device 84, the spring 16 being stopped and retarded by the gate 80 will be in no position to be transmitted along the peening path by that particular finger 42. However, as a particular finger 42 is at the finger position sensing device 84, it serves as a positive indication that the spring 16 previously supplied to the region at the entrance end of the spinner rolls 36 is being conveyed thereon for passage through the critical blasting region 17. Accordingly, the movement of each finger 42 by the sensing device 84 indicates that there is no longer a spring 16 at the trailing end of the chain 58 of the separating and feeding system 54 and a new spring 16 must then be supplied for the next proceeding finger 42. As indicated hereinabove, the horizontal speed of the chain 58 of the separating and feeding system 54 is by design to be greater than the speed of the fingers 42. Once the spring stop and shot sealing gate 80 is opened, the next spring 16 is rapidly transmitted to the end of the chain 58 at the sprocket 64 to be in a position for the next finger 42. Each spring 16 will extend at least partially onto the spinner rolls 36 under the frictional force of the chain 58. However, a spring 16 will not be fully positioned on the spinner rolls 36 or removed from the chain 58 sliding therebeneath until the next, appropriate finger 42 is properly, laterally positioned for conveying it into the critical blast regions 17.

It should now be clear that as long as there is provided a continuous supply of springs 16 to the first gate 72, the separating and feeding system 54 will automatically space and feed springs 16 to a position within the interior of the shot peening housing 22 as each finger 42 is in a position for its further conveyance through the critical blast region 17. The first gate 72 tends to initially retard each spring to insure that only one spring is positioned at the second gate 76. The second gate 76 tends to prevent any spring 16 from being provided to the spring stop and shot sealing gate 80 until a spring initially positioned there has been fully transported into the entrance chamber 24. Gate 80 will prevent a spring held thereby from entering the entrance chamber 24 until the finger position sensing device 84 indicates that the previously supplied spring 16 is now being moved horizontally onto the rolls 36. The spring stop and shot sealing gate 80 will then automatically close after the spring has passed completely therethrough and prior to the next spring being provided thereto. The secondary sealing gate 86 will only close to provide a secondary shot sealing means during the time that gate 80 is opened and will then be vertically retracted after a predetermined time which is sufficiently short to insure that no contact is made with a spring 16 passing therethrough. As a result, the spring 16 is capable of being positioned at the end of the chain 58 to be further transmitted by the next finger 42.

In the preferred separating and feeding system 54, each of the gates 72, 76, 80 and 86 are controlled by air operated cylinders. A control system (not shown) of a type which is well known in the machine control art is capable of actuation and deactuation of the cylinders according to various preplanned signals. Preferably, the spring sensing devices 74 and 78 are photocells but any number of other types of sensing devices might alternatively be utilized.

The discharge system 56 is provided to insure positive discharge of the springs 16 after they have passed through the critical blasting region 17. The discharge system 56 also includes a horizontally extending chain 90 which is aligned with the exit end of the spinner rolls 36. The chain 90 extends between a leading end sprocket 92 and a driven sprocket 94 which is driven by a fixed-speed motor 96.

The upper surface of the chain 90 moves in a direction for continued passage of each spring 16 from the exit chamber 26 to the exterior of the housing 22. On the return passage of the chain 90, it is caused to pass through a pair of adjustable idler sprockets 98 to provide proper tension for the chain 90. The speed of the chain 90 is preset to move much faster than the fingers 42. As a finger 42 has conveyed a spring 16 through the critical blast region 17, it continues to convey the spring off of the end of the spinner rolls 36 and onto the upper surface of the chain 90. Since the chain 90 is traveling at a higher rate, the spring 16 is propelled away from its finger 42 to provide sufficient space therebetween for the finger 42 to then be retracted from the exit chamber 26. In other words, each finger 42 will no longer be in contact with its spring 16 when that portion of the chain 44 on which it is supported is passing around the driven sprocket 46 and the finger 42 is being returned to the interior of the back chamber 28.

Again, to prevent inadvertent loss of shot which tends to ricochet within the interior of the housing 22, the discharge system 56 is provided a pair of gates 100 and 102. The gates 100 and 102 are both hinged gravity return shot sealing gates which are opened by the spring as it passes therethrough. After each spring 16 passes through the open gate 100, 102, the gate will automatically close to retard any shot which may have found its way into the exit chamber 26.

Having thus explained the overall operation of the preferred shot peening machine 10, it is appropriate to explain some of the versitility of the preferred shot peening machine and how it is basically operated to perform the shot peening operation on various springs. Initially, the operator must analyze the particular spring to be peened. If the spring has a small diameter, it is possible that the spinner rolls 36 must initially be adjusted to reduce the space therebetween to insure they will properly support and rotate the spring thereon. Further, the operator must determine how long the particular spring should be retained with the critical blast region 17. The length of time the spring should be retained within the critical blast region 17 will dictate the speed at which the conveyor chain 44 of the preferred conveying means 30 will be operated. Depending on the length of the spring, the fingers 42 may or may not be properly horizontally spaced. It should be kept in mind, that additional fingers 42 can be added to the chain 44 as long as the spacing between each finger 42 and its adjacent fingers 42 is identical. Generally, a spring must not be too close to the immediately preceding spring to insure that the ends of each spring are properly peened. In any case, the operator will realize that for a fixed rate through the critical blasting region 17, the overall number of springs to be peened can be increased if the distance between adjacent fingers 42 is kept to a minimum. While determining how long the spring will be retained in the critical blast region 17, a determination of its rotational speed will also be made to establish the speed setting for the motor 40 and the spinner rolls 36.

Once the speed of the chain 44 and the distance between the fingers 42 thereon is properly determined, the speed of the separating and feeding system 54 can be selected. As indicated hereinabove, the speed of the chain 58 thereof will definitely be faster than will be the speed of the conveyor chain 44. Regulation of the motor drive 70 of the separating and feeding system 54 will not directly effect the operation of the gates 72, 78, 80 and 86, since they will automatically be controlled by the various spring and finger sensing devices. However, the time delay after initiation of the finger position sensing device 84 will be separately regulated to insure free movement of the spring after it enters the entrance chamber 24. As mentioned hereinabove, the discharge system 56 is operated at a predetermined speed which is sufficiently great to insure removal of each spring throughout the range of speeds at which the conveying system 30 can be set.

Although the particular components to be found in the machine may vary by design according to the range of springs to be peened therein, there are certain features of the preferred shot peening machine 10 which should be described in order to provide a better understanding of its overall operations. For example, the springs which might be peened in the preferred shot peening machine 10 could have an outside diameter ranging from 2⅝ inches to 11½ inches. Springs of various shapes such as cylindrical, conical or barrel springs could all be satisfactorily peened in the machine 10. To insure proper cold working of this wide range of spring sizes and shapes, the preferred blast wheels are 2½ inches wide with a 19½ inch diameter and are driven by a 40 horse power motor mounted on top of the blast cabinet 12.

The critical blast region 17 would be approximately nine feet long. To properly control the springs within the critical blast region 17, as menitioned hereinabove, the spinner rolls 36 can be adjusted to vary the space therebetween to accommodate springs having any outside diameter within the range mentioned hereinabove while the speed of rotation can be adjusted to insure proper cold working of the particular spring being supported thereby. The variable speed drive for the conveying system 30 can be set to convey the fingers 42 at a speed of 9 to 27 feet per minute. The fingers 42 are approximately 15 inches long and made of ¾ inch diameter manganese steel alloy and are aligned to pass through the slot 50 which is approximately 1 inch wide. The chain 58 of the separating and feeding system 54 can be regulated to operate at a speed of 30 to 90 feet per minute. The fixed speed for the discharge system 56 is set at 130 feet per minute and, as indicated hereinabove, is adequate for all settings for the conveying system 30.

As a general rule, the components described hereinabove are capable of accommodating springs at a production rate of between 240 and 720 springs per hour. Assuming a production rate of 600 springs per hour, each spring would be fed into, conveyed through, and discharged from the preferred shot peening machine 10 at a rate of 1 every 6 seconds.

It should be kept in mind that any number of alterations may be made to the preferred separating and feeding system 54 without departing from the invention as claimed. Specifically, although the preferred separating and feeding system 54 utilizes a single chain 58, this is made possible by the utilization elsewhere in the preferred shot peening machine 10 of the horizontally extending fingers 42 for the conveying of the springs through the critical blast region 17. If, for example, one were to utilize a different conveying system, such as those shown in the prior art, utilizing a configuration of vertically extending fingers, there could be provided for the separating and feeding system a pair of horizontally separated chains which could properly support the springs therebetween and allow each of the fingers to extend therebetween for further conveyance of the springs. Additionally, although not specifically mentioned during the discussion of the preferred embodiment hereinabove, the first gate 72, second gate 74, and the first spring sensing the device 74 are arranged on the frame 60 to be axially moveable thereon. In other words, the gates and sensing device can be longitudinally adjusted according to the overall length of any particular spring if such adjustment will facilitate overall regulation the separating and feeding function for properly supplying the springs to the critical blast region. Obviously, any number of other types of physically arranged gates, finger sensing devices, and/or spring sensing devices could be utilized to still perform the basic function of the separating and feeding system without departing from the spirit of the invention as claimed.

I claim:

1. A separating and feeding system for a shot peening machine of the type which includes blast wheel means or the like which is mounted on a housing thereof and is capable of propelling a plurality of shot generally downwardly into a critical blast region within said housing for shot peening a plurality of work pieces passing therethrough, said work pieces being supported on and separately conveyed along a horizontal peening path into one side of, through, and out another side of said critical blast region, said separating and feeding system comprising:

an entrance chamber within said housing adjacent said critical blast region at said one side thereof;

an elongated, horizontally extending support surface mounted relative to said housing for continuous movement from a first end exterior of said housing through an opening in a wall of said housing to a second end within said entrance chamber at said one side of said critical blast region;

said horizontally extending support surface being capable of supporting said work pieces thereon and making sufficient frictional contact therewith for transportation of said work pieces from said first end to said second end thereof, said horizontally extending support surface being able to continue said movement beneath any of said work pieces which are prevented by retarding means from continuing said transportation;

said retarding means including a shot screening and work piece stopping gate in a normally closed position at said opening to prevent escape of said shot therethrough and entrance of one of said work pieces into said entrance chamber;

means for indicating when said one side of said critical blast region is available for delivery of said one work pieces thereto;

said means for indicating producing a signal for opening said shot screening and work pieces stopping gate for a predetermined amount of time to allow said movement of said horizontally extending support surface to cause said transportation of said one work piece into said entrance chamber, to said second end of said horinzontally extending support surface and to said one side of said critical blast region; and a secondary shot screening gate between said shot screening and work piece stopping gate and said second end of said horizontally extending support surface, said secondary shot screening gate being in a normally opened position, receiving said signal from said means for indicating to be closed thereby for said predetermined amount of time when said shot screening and work piece stopping gate is opened and returning to said normally opened position prior to said transportation of said one work piece therethough to insure it will not retard as transportation of said one work piece to said second end of said horinzontally extending support surface and said one side of said critical blast region.

2. The separating and feeding system as set forth in claim 1, wherein said horizontally extending support surface includes an upper pass of a chain loop, said chain loop being vertically oriented and including a first sprocket at said first end thereof and a second sprocket at said second end thereof to be driven in a direction in which said upper pass will continuously move from said first end to said second end.

3. The separating and feeding system as set forth in claim 2, wherein said chain can be driven at various speeds to correspond with a speed of said work pieces being separately conveyed along said horizontal peening path.

4. A separating and feeding system for a shot peening machine of the type which includes blast wheel means or the like which is mounted on a housing thereof and is capable of propelling a plurality of shot generally downwardly into a critical blast region within said housing for shot peening a plurality of work pieces passing therethrough, said work pieces being supported on and separately conveyed along a horizontal peening path into one side of, through, and out another side of said critical blast region, said separating and feeding system comprising:

an entrance chamber within said housing adjacent said critical blast region at said one side thereof;

an elongated, horizontally extending support surface mounted relative to said housing for continuous movement from a first end exterior of said housing through an opening in a wall of said housing to a second end within said entrance chamber at said one side of said critical blast region;

said horizontally extending support surface being capable of supporting said work pieces thereon and making sufficient frictional contact therewith for transportation of said work pieces from said first end to said second end thereof, said horizontally extending support surface being able to continue said movement beneath any of said work pieces which are prevented by retarding means from continuing said transportation;

said retarding means including a shot screening and work piece stopping gate in a normally closed position at said opening to prevent escape of said shot therethrough and entrance of one of said work pieces into said entrance chamber;

means for indicating when said one side of said critical blast region is available for delivery of said one work pieces thereto;

said means for indicating producing a signal for opening said shot screening and work pieces stopping gate for a predetermined amount of time to allow said movement of said horizontally extending support surface to cause said transportation of said one work piece into said entrance chamber, to said second end of said horizontally extending support surface and to said one side of said critical blast region;

a primary work piece sensing means at a side of said shot screening and work piece stopping gate toward said first end of said horizontally extending support surface; and said retarding means including a primary separating gate between said first end of said horizontally extending support surface and said shot screening and work piece stopping gate, said primary separating gate being in a normally closed position to retard said one work piece whenever a preceding work piece has been sensed by said primary work piece sensing means to be at said shot screening and work piece stopping gate, said primary separating gate receiving said signal from said means for indicating to be opened thereby to release said one work piece, and said primary separating gate being returned to said closed position to retard a next said work piece when said one work piece is sened by said primary work piece sensing means to be at said shot screening and work piece stopping gate.

5. The separating and feeding system as set forth in claim 4, further including another work piece sensing means at a side of said primary separating gate toward said first end of said horizontally extending support surface and wherein said retarding means includes another separating gate between said first end of said horizontally extending support surface and said primary separating gate, said another separating gate is in a normally closed position to retard said one work piece whenever said preceding work piece has been sensed by said another work piece sensing means to be at said primary separating gate, said another separating gate receives a signal to be moved to an open position to release said one work piece when said preceeding work piece is sensed by said primary work piece sensing means at said shot screening and work piece stopping gate, and said another separating gate is returned to said normally closed position to retard said next work piece when said one work piece is sensed by said another work piece sensing means to be at said primary separating gate.

* * * * *